US007920818B2

(12) United States Patent
Pee

(10) Patent No.: US 7,920,818 B2
(45) Date of Patent: Apr. 5, 2011

(54) IMAGE FORMING APPARATUS WHICH CAN EXPAND SPACE OF DISCHARGING UNIT

(75) Inventor: Jae-hui Pee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1004 days.

(21) Appl. No.: 11/521,375

(22) Filed: Sep. 15, 2006

(65) Prior Publication Data

US 2007/0086795 A1 Apr. 19, 2007

(30) Foreign Application Priority Data

Oct. 17, 2005 (KR) ..... 10-2005-0097730

(51) Int. Cl.
*G03G 15/00* (2006.01)
*B65H 29/00* (2006.01)
*B65H 31/00* (2006.01)

(52) U.S. Cl. ..... 399/405; 399/16

(58) Field of Classification Search ..... 399/405, 399/16

See application file for complete search history.

(56) References Cited

U.S. PATENT DOCUMENTS

| | | | | |
|---|---|---|---|---|
| 6,382,614 | B1 * | 5/2002 | Fukatsu et al. | 270/58.11 |
| 7,263,312 | B2 * | 8/2007 | Park | 399/124 |
| 2003/0016977 | A1 * | 1/2003 | Shiraishi et al. | 399/405 |
| 2003/0198493 | A1 | 10/2003 | Gomi et al. | |
| 2005/0135855 | A1 * | 6/2005 | Park et al. | 399/405 |

FOREIGN PATENT DOCUMENTS

| | | | |
|---|---|---|---|
| GB | 2149447 | A * | 6/1985 |
| JP | 61-203436 | | 9/1986 |
| JP | 63-295364 | | 12/1988 |
| KR | 2003-56549 | | 7/2003 |

* cited by examiner

*Primary Examiner* — Daniel J Colilla
*Assistant Examiner* — Allister Primo
(74) *Attorney, Agent, or Firm* — Staas & Halsey LLP

(57) ABSTRACT

An image forming apparatus which can expand the space of a discharging unit includes a scanner rotating unit provided below a scanner unit to rotate the scanner unit, to open the top of a discharging unit, and to expand a space of the discharging unit if the collective height of sheets accumulated in the discharging unit reaches or exceeds a predetermined value, and a control unit arranged to detect whether the collective height of the sheets accumulated in the discharging unit reaches or exceeds the predetermined value to operate the scanner rotating unit in accordance with the detection result.

16 Claims, 5 Drawing Sheets

IMAGE FORMING APPARATUS WHICH CAN EXPAND SPACE OF DISCHARGING UNIT

CROSS-REFERENCE TO RELATED APPLICATION

This application claims the benefit of Korean Patent Application No. 2005-97730, filed on Oct. 17, 2005 in the Korean Intellectual Property Office, the disclosure of which is incorporated herein in its entirety by reference.

BACKGROUND OF THE INVENTION

1. Field of the Invention

Aspects of the present invention relate to an image forming apparatus, and more particularly, to an image forming apparatus which can expand the space of a discharging unit.

2. Related Art

An image forming apparatus generally includes: a charging unit which charges the surface of a photosensitive body to a predetermined potential; an exposure unit which irradiates light onto the surface of the photosensitive body using a light scanning unit such as a laser scanning unit (LSU) to form an electrostatic latent image thereon; a developing unit which supplies a developing agent such as toner onto the electrostatic latent image to develop it into a visible image such as a toner image; a sheet feeding unit which picks up individual sheet of printable media, such as paper, loaded in a main sheet feeding cassette and conveys the individual sheet of paper along a conveying path; a transferring unit which transfers the visible image formed on the photosensitive body onto the sheet of paper; a fixing unit which fuses the visible image onto the sheet of paper via high temperature and high pressure; and a discharging unit which discharges the sheet of paper on which the visible image has been fused from the image forming apparatus.

Examples of such an image forming apparatus include a printer, a scanner, a copier, and a facsimile machine used to print characters or pictures on printable medium. Recently, a multi-functional product capable of performing various functions including printing, scanning, copying and facsimileing has become widely used. This multi-functional product combines a scanner unit for reading an image from an original sheet using an optical signal and converting the optical signal into an electrical signal, and a printer unit for forming an image on a sheet of printable medium, such as paper or film.

Accordingly, when the multi-functional product individually performs scanning and printing, the scanner unit and the printer unit are individually driven. Furthermore, when the multi-functional product performs copying, the scanner unit and the printer unit are utilized to print the same image as that of the original sheet, onto another sheet. That is, when the original sheet on which an image is formed is laid on the scanner unit of the multi-functional product, the scanner unit scans the image on the original sheet and transfers scan data of the image to the printer unit and the printer unit develops, transfers, and fuses the same image in accordance with the transferred scan data, thereby forming the image of the original sheet on another sheet.

Meanwhile, in order to minimize the size of the multi-functional product having various functions, a discharging unit in which discharged sheets are accumulated has been designed to be as small as possible. However, if the discharging unit placed between the scanner unit and the printer unit is minimized, the capacity of the discharging unit may become smaller.

Accordingly, in order to address this problem, the scanner unit as well as an original sheet cover unit is hinge-coupled to a main body of a multi-functional product, thereby allowing it to rotate upward. If the discharged sheets are accumulated and the discharging unit has no space, the scanner unit is pushed up to expand the space of the discharging unit. To this end, a scanner rotating unit is provided in the main body of the multi-functional product.

However, since the scanner rotating unit is operated manually, its operation can be inconvenient to a user. In addition, when the scanner unit is held close to the main body, it is difficult to find out how many sheets of printable media are accumulated in the discharging unit. Furthermore, if the scanner unit is not pushed up in time, a paper jam may occur due to successive discharging of the sheets of the printable media.

SUMMARY OF THE INVENTION

Several aspects and example embodiments of the present invention provide an image forming apparatus which can expand and restore the space of a discharging unit without increasing the size of the apparatus.

Aspects of the present invention also provide an image forming apparatus which can easily expand the space of a discharging unit.

Aspects of the present invention also provide an image forming apparatus which can expand the space of a discharging unit when necessary to prevent paper jams.

In accordance with an embodiment of the present invention, there is provided an image forming apparatus including: a main body; a printer unit which is provided at the bottom of the main body to print an image on a sheet of printable media; a discharging unit provided above the printer unit to load the sheet of printable media discharged from the printer unit; a scanner unit provided above the printer unit to rotate about a hinge unit coupled to the main body so as to open and close the top of the discharging unit; a scanner rotating unit provided below the scanner unit to rotate the scanner unit, to open the top of the discharging unit, and to expand the space of the discharging unit if the collective height of the sheets of printable media accumulated in the discharging unit reaches or exceeds a predetermined value; and a control unit arranged to detect whether the collective height of the sheets of printable media accumulated in the discharging unit reaches or exceeds the predetermined value and operate the scanner rotating unit in accordance with the detection result. According to an aspect of the present invention, there is a method of expanding a space in a discharging unit in an image forming device, including a main body, a scanner rotating unit with a reciprocating plunger, and a scanner, including: detecting a collective height of sheets of printable media accumulated in the discharging unit that reaches or exceeds a first predetermined height; and activating the reciprocating plunger of the scanner rotating unit based on the detected collective height reaching or exceeding the first predetermined height so that the plunger pushes the scanner unit away from the main body of the image forming apparatus.

According to an aspect of the present invention, there is an image forming apparatus, including, a main body; a scanner unit hinged to the main body; a discharge unit provided between the main body and the scanner unit; and a scanner rotating unit provided between the main body and the scanner unit, the scanner rotating unit comprising a reciprocating plunger that is not fixed to the scanner unit.

Additional aspects and/or advantages of the invention are set forth in the description which follows or are evident from the description, or can be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
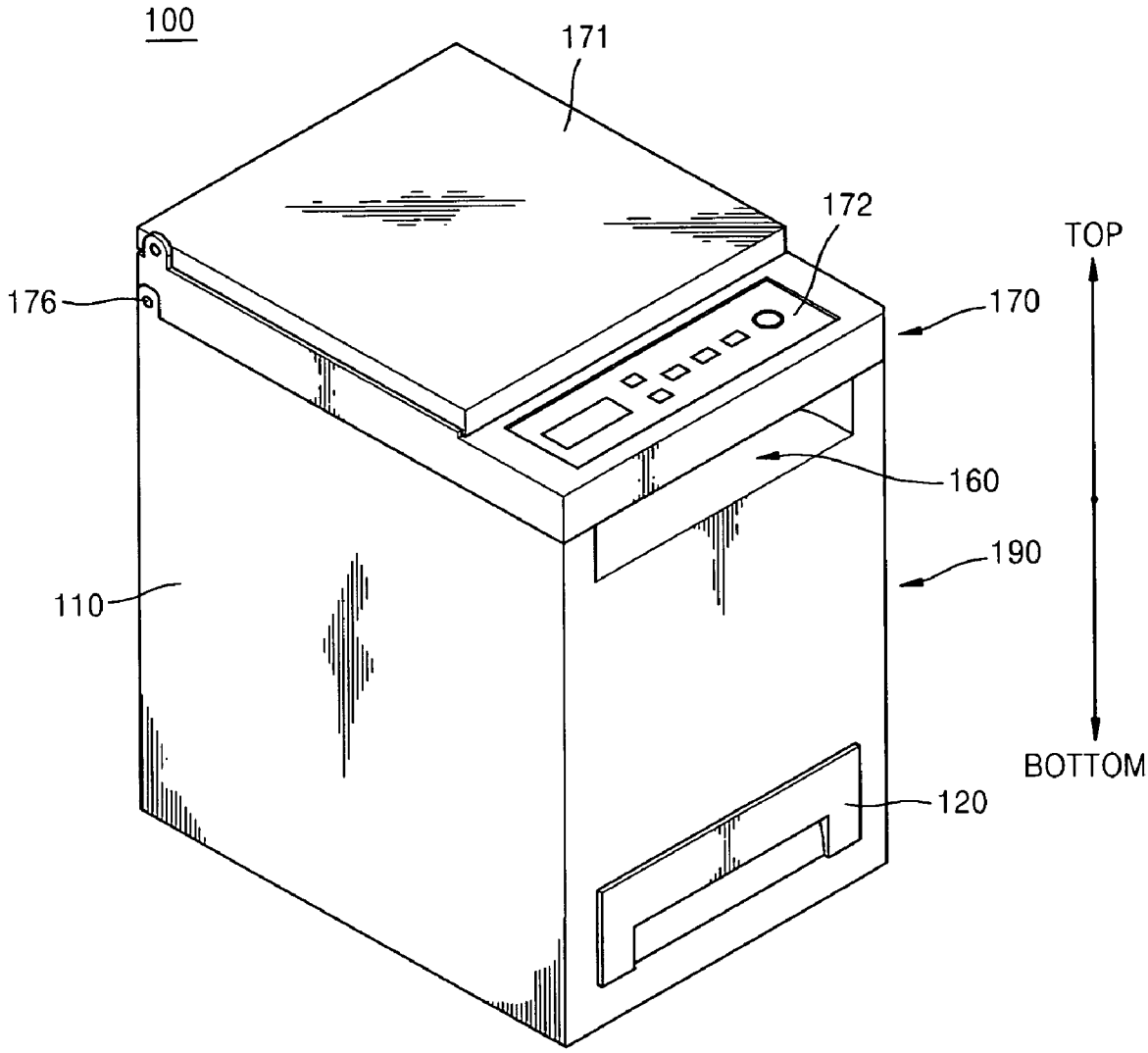
FIG. 1 is a perspective view schematically illustrating an image forming apparatus according to an example embodiment of the present invention.

Reference will now be made in detail to embodiments and aspects of the present invention, examples of which are illustrated in the accompanying drawings, wherein like reference numerals refer to the like elements throughout. The embodiments and aspects are described below in order to explain the present invention by referring to the figures, with well-known functions or constructions not necessarily being described in detail.

Figure 2:
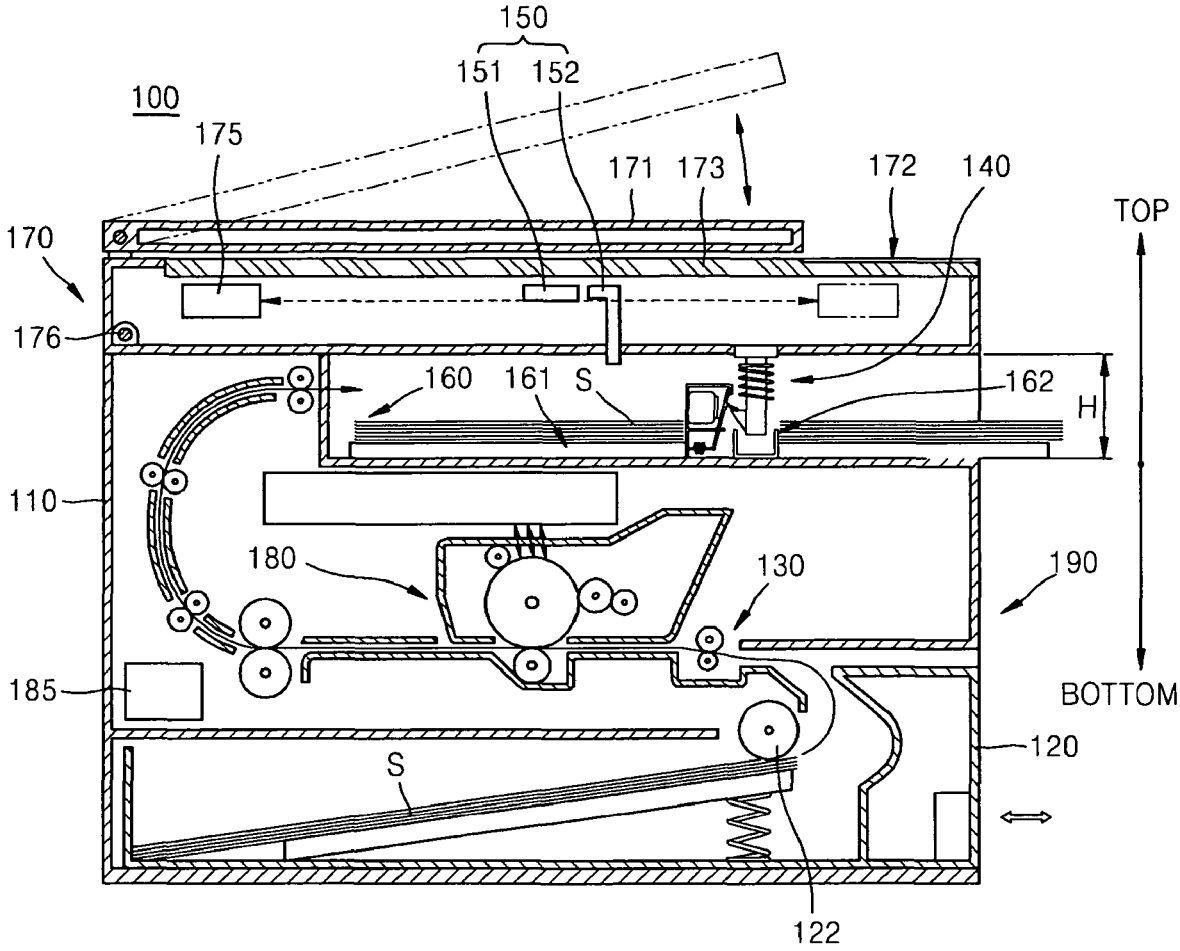
FIG. 2 is a side cross-sectional view schematically illustrating the image forming apparatus according to the example embodiment of the present invention.

FIG. 1 is a perspective view schematically illustrating an image forming apparatus 100 according to an aspect of the present invention, and FIG. 2 is a side cross-sectional view schematically illustrating the image forming apparatus 100 according to the an aspect of the present invention. The image forming apparatus 100, as shown in FIGS. 1 and 2, represents a multi-functional product; however, such an image forming apparatus also represents a printer, a scanner, a photocopier, and a facsimile machine.

Referring to FIGS. 1 and 2, the image forming apparatus includes a main body 110, a printer unit 190 which is provided at the bottom of the main body 110 and which prints an image on a sheet of paper S, a scanner unit 170 which is provided at the top of the main body 110, and more particularly, above the printer unit 190, and which scans an image of an original sheet, a discharging unit 160 which is provided between the printer unit 190 and the scanner unit 170 such that the sheet S is accumulated onto the discharging unit 160 after being printed on by the printer unit 190 so that the sheet S is discharged, via an opening, a discharge sensor unit 150 which detects whether the collective height of the sheets S accumulated in the discharging unit 160 exceeds (or reaches) a predetermined value, a scanner rotating unit 140 which receives an electrical signal from the discharge sensor unit 150 through a control unit 185 and which pushes up the scanner unit 170, and a sheet feeding cassette 120 in which a plurality of sheets S of printable media are accumulated and which is detachable from the main body 110.

In more detail, the printer unit 190 includes a sheet feeding roller 122 for feeding each sheet S of printable media into the main body 110, a sheet conveying roller 130 which conveys the sheet S to a developer unit 180 which forms an image on the sheet S, and the control unit 185 which controls the printer unit 190 and the scanner unit 170. In the aspect of the present invention shown, the control unit 185 receives the electrical signal from the discharge sensor unit 150 and controls the operation of the scanner rotating unit 140.

The scanner unit 170 includes an original sheet rack 173 which is made of a transparent material and on which an original sheet is laid, a scanning sensor 175 which scans the image on the original sheet laid on the original sheet rack 173, an original sheet cover 171 which is hinge-coupled to the scanner unit 170 to press the original sheet laid on the original sheet rack 173, and an operation panel 172. Furthermore, the scanner unit 170 is rotatably mounted on the main body 110 by a hinge 176 to open and close the top of the discharging unit 160.

In a non-limiting example of the present invention, the original sheet rack 173 may be formed of flat glass, and the scanning sensor 175 may be a charge coupled device (CCD) sensor which can scan an image on the original sheet.

The operation panel 172 includes, for example, a power supply button, a copy/print start button, a copy/print number input button, a scanner unit open button, and a sheet discharge command display panel.

The discharging unit 160 is placed between the printer unit 190 and the scanner unit 170 such that the sheet S discharged from the printer unit 190 is accumulated into the discharging unit 160. The discharging unit 160 has a space having a height H such that a plurality of sheets S can be accumulated thereon. In addition, a discharging tray 161 in which the accumulated sheets S are accumulated may be provided in the discharging unit 160. The sheets S fed from the sheet feeding cassette 120 are conveyed along a sheet conveying path defined by various rollers not labeled and sequentially accumulated beginning at the bottom of the discharging unit 160.

The discharge sensor unit 150 is provided in at least one of the scanner unit 170, the printer unit 190, and a portion between the scanner unit 170 and the printer unit 190, and includes a discharge sensor 151 and an actuator 152 for operating the discharge sensor 151. The actuator 152 is rotatably provided in the image forming apparatus 100, so that when the collective height of the sheets S accumulated in the discharging unit 160 exceeds (or reaches) a predetermined value, the actuator 152 is rotated due to contact with the accumulated sheets S and operates the discharge sensor 151. The discharge sensor 151 then transmits an electrical signal to the control unit 185 to allow the control unit 185 to operate the scanner rotating unit 140. In a non-limiting aspect of the present invention, the discharge sensor 151 may be a non-contact type photo sensor, such as optical sensors. However, in other aspects of the present invention, the discharge sensor 151 may be a contact type sensor, such as pressure sensors.

The operation of the discharge sensor 151 will now be described in detail. When the collective height of the sheets S accumulated in the discharging unit 160 exceeds (or reaches) a predetermined value and the actuator 152 contacts the accumulated sheets S, the actuator 152 is rotated by contact with the accumulated sheets S. At least a portion of the actuator 152 enters a sensing region A (shown in FIG. 3) of the discharge sensor 151 and the discharge sensor 151 is turned on. Accordingly, the scanner rotating unit 140 is actuated by the discharge sensor 151 and the scanner unit 170 is pushed up. Once the scanner unit 170 is pushed up, the actuator 152 is removed from contacting the accumulated sheets S. At this time, the actuator 152 returns to its original position and is removed from the sensing region A of the discharge sensor 151. Once the actuator 152 is removed, the discharge sensor 151 is turned off. As to turning on or off the discharge sensor 151, in other aspects of the present invention, the discharge sensor 151 is turned on when the actuator is returned to its original position. Accordingly, when the actuator 152 is rotated by contact with the accumulated sheets S or is returned to its original position, the discharge sensor 151 may be in any one of the on and off states. As to a placement of the discharge sensor unit 150, although not required in all aspects, the discharge sensor unit 150 may be attached to the scanner unit 170.

When the collective height of the accumulated sheets S exceeds (or reaches) the predetermined value, the scanner rotating unit 140 is actuated so that the scanner rotating unit 140 pushes up and holds the scanner unit 170 in a raised position. When the scanner unit 170 is returned to its original position, the scanner rotating unit 140 is also returned so that the scanner rotating unit 140 holds the scanner unit 170 in the original position. The detailed structure and operation of the scanner rotating unit 140 will be described herein below.

When the image forming apparatus 100 according to the present embodiment performs a copying/printing function, its operation can be described as follows. When an original sheet having an image is laid on the upper surface of the original sheet rack 173, the scanning sensor 175 of the scanner unit 170 scans the image on the original sheet while moving along the length of the original sheet laid on the original sheet rack 173, and transmits scan data to the control unit 185. Next, a sheet S is picked up by the sheet feeding roller 122 and fed to the sheet conveying rollers 130 from the sheet feeding cassette 120, the sheet conveying rollers 130 convey the fed sheet S into the printer unit 190, and the control unit 185 transmits an electrical signal to the developer unit 180 in accordance with the scan data transmitted from the scanner unit 170. The developer unit 180 forms the scanned image on the sheet S conveyed into the printer unit 190 in accordance with the electrical signal from the control unit 185. The sheet conveying rollers 130 discharges the printed sheet S to the discharging unit 160. The sheet S accumulated in the discharging unit 160 is accumulated on the discharge tray 161 in the discharging unit 160.

Figure 3:
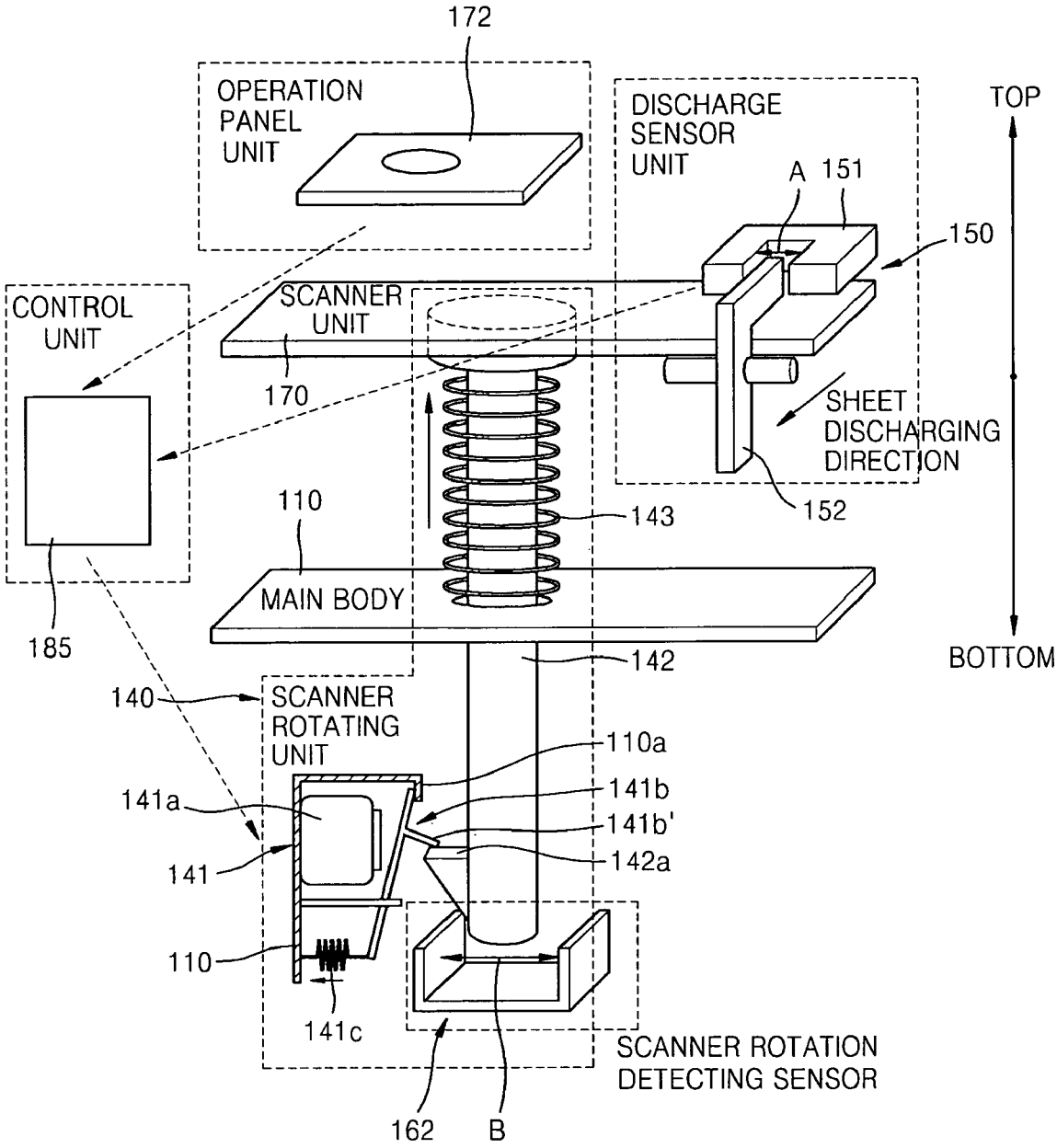
FIG. 3 illustrates the procedure and the units involved in expanding a space of a discharging unit of the image forming apparatus illustrated in FIG. 2.
Figure 4:
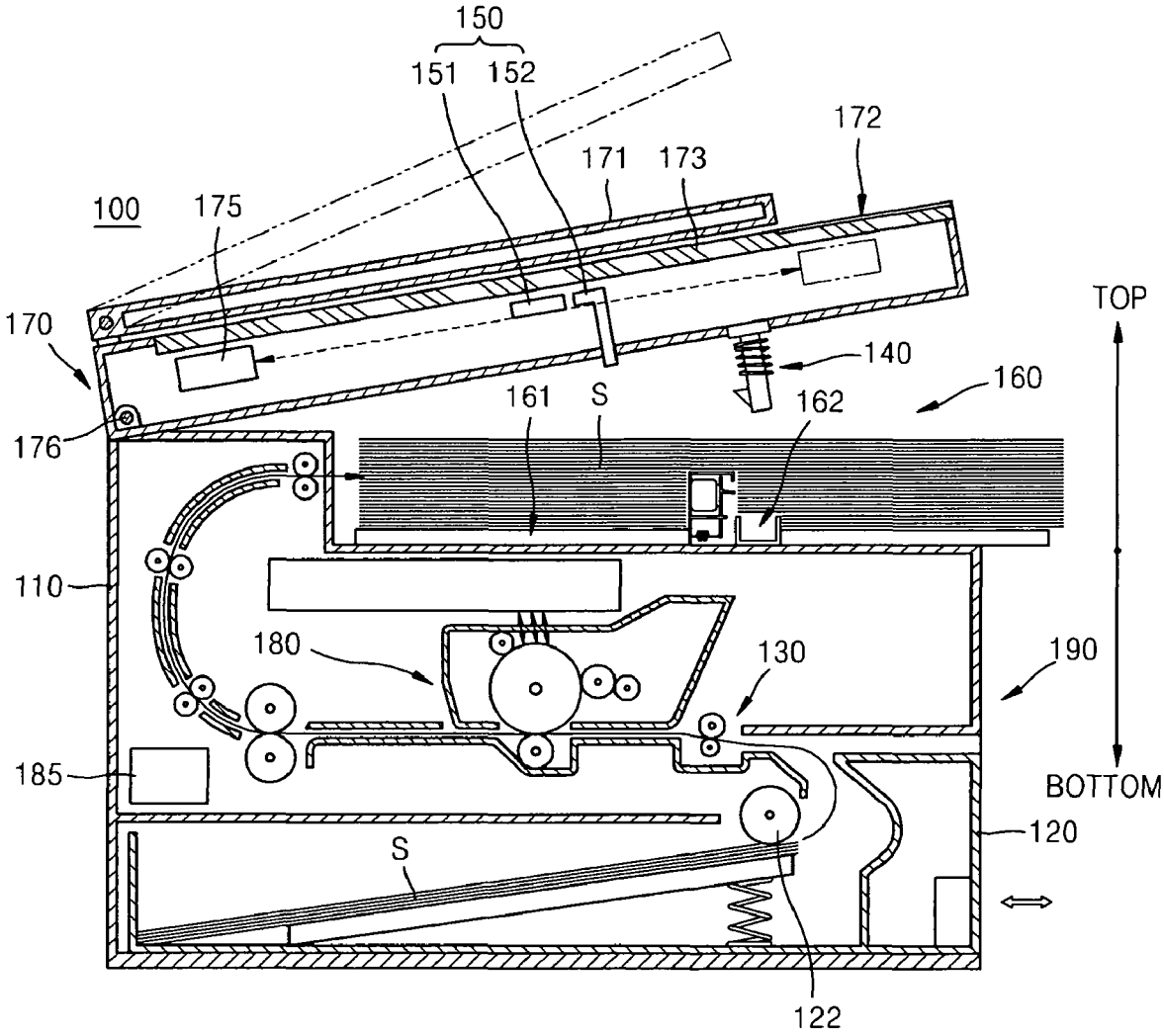
FIG. 4 is a side cross-sectional view illustrating an expanded state of the space of the discharging unit of the image forming apparatus illustrated in FIG. 2.
Figure 5:
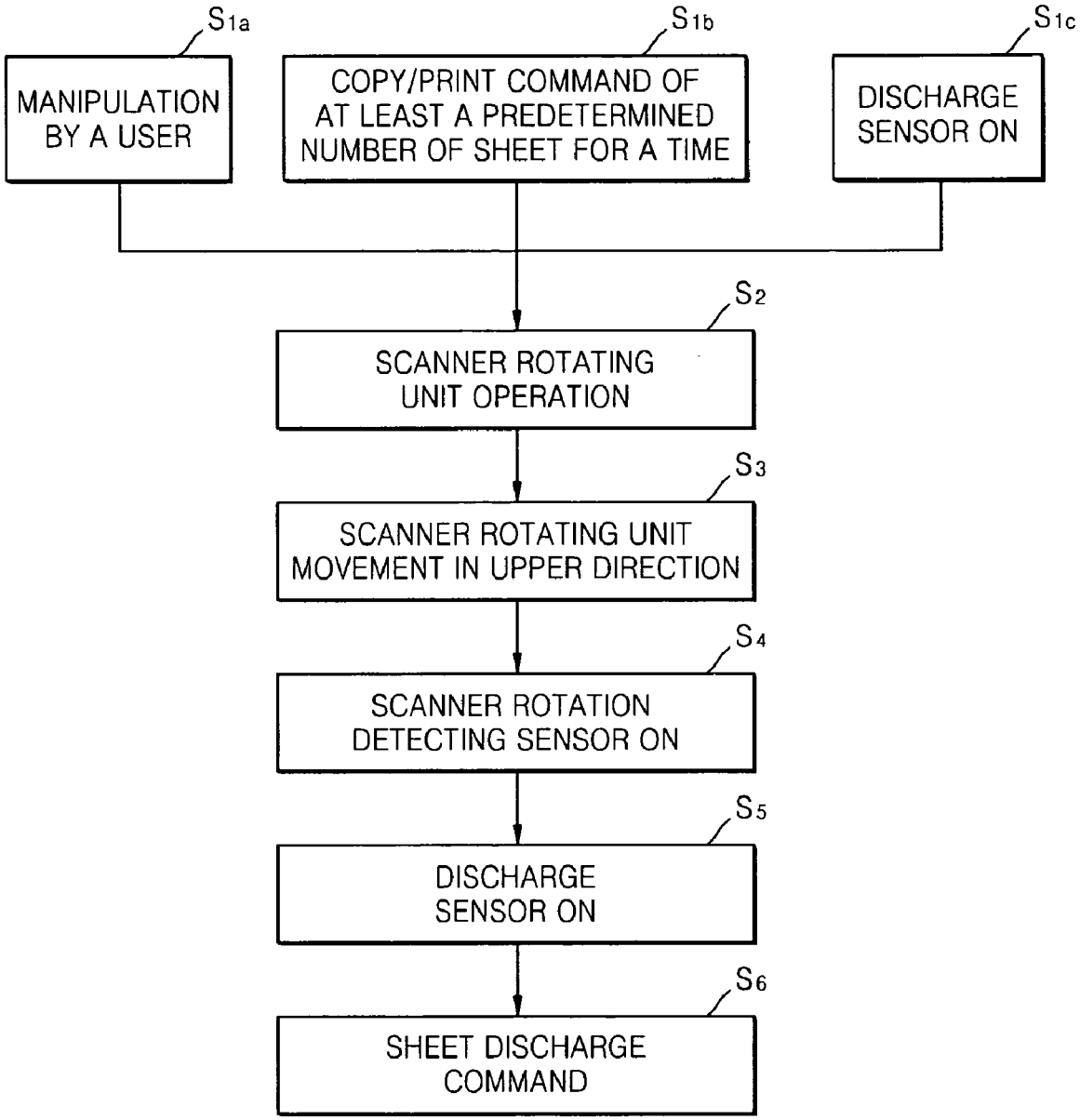
FIG. 5 is a flowchart illustrating a method of expanding a space of a discharging unit of an image forming apparatus according to an example embodiment of the present invention.

FIG. 3 illustrates the procedure and units involved in expanding the space of the discharging unit 160 of the image forming apparatus 100 illustrated in FIG. 2. FIG. 4 is a side cross-sectional view illustrating an expanded state of the space of the discharging unit 160 of the image forming apparatus 100 illustrated in FIG. 2, and FIG. 5 is a flowchart illustrating a method of expanding the space of a discharging unit of an image forming apparatus according to an example embodiment of the present invention. The apparatus of FIGS. 1-4 may be used to implement the method of FIG. 5, but such use is not required.

Referring to FIG. 3, the scanner rotating unit 140 includes a plunger 142, a restriction unit 141, and a first spring 143. The plunger 142 moves reciprocally to push or support the scanner unit 170 during respective up and/or down movements. One end of the plunger 142 faces the scanner unit 170 and the other opposite end has a hook 142*a*. The plunger 142 has an elongated shape. In a non-limiting example of the present invention, the plunger 142 is not fixed to the scanner unit 170 or its components, the original sheet cover unit 171, the operation panel unit 172, and/or the original sheet rack 173.

The restriction unit 141 is placed adjacent to the lower end of the plunger 142, and restricts the reciprocal movement of the plunger 142. The restriction unit 141 includes a fixed rod 141*b*, an electromagnet 141*a*, and a second spring 141*c*.

The fixed rod 141*b* has an engagement jaw 141*b*' (a first engagement jaw), which engages with the hook 142*a* of the plunger 142 such that the plunger 142 is held at the lower end of its movement path by the fixed rod 141*b*. One end of the fixed rod 141*b* contacts an engagement jaw 110*a* (a second engagement jaw) of the main body 110 when the plunger 142 is held by the fixed rod 141*b*, and is spaced apart from the engagement jaw 110*a* of the main body 110 when the plunger 142 is released so that the hook 142*a* of the plunger 142 is not held by the engagement jaw 110*a*. In a non-limiting aspect of the present invention, the fixed rod 141*b* may be formed of a magnetic material so that the fixed rod is attachable and detachable to the electromagnet 141*a*.

In a non-limiting aspect of the present invention, the electromagnet 141*a* forms a solenoid. Accordingly, the upper end of the fixed rod 141*b* is attached to or detached from the electromagnet 141. When current flows in the electromagnet 141*a*, the fixed rod 141*b* is attached to the electromagnet 141*a* and, when current does not flow in the electromagnet 141*a*, the fixed rod 141*b* is detached and released from the electromagnet 141*a*.

The second spring 141*c* is attached to the end of the fixed rod 141*b* that is placed below the engagement jaw 141*b*', and pulls the end of the fixed rod 141*b* towards the main body 110. Accordingly, the second spring 141*c* elastically biases one end (the bottom end) of the fixed rod 141*b* to the main body 110 such that the engagement jaw 141*b*' of the fixed rod 141*b* is coupled to the hook 142*a* of the plunger 142 when the current does not flow in the electromagnet 141*a*.

The elastic force of the first spring 143 biases the plunger 142 towards the scanner unit 170. In the aspect of the present invention shown in FIG. 3, the first spring 143 surrounds the plunger 142. However, it is understood that the plunger 142 may be urged toward and/or support the scanner unit 170 by mechanical means as well, such as a rack and pinion gear, whereby the rack is formed along the length of the plunger 142.

A scanner rotation detecting sensor 162 is further provided in the main body 110 below the plunger 142 in an opposite direction of the plunger 142 from the scanner unit 170. In a non-limiting aspect of the present invention, the scanner rotation detecting sensor 162 is a non-contact type photo sensor. However, it is understood that in other aspects of the present invention, the scanner rotation detecting sensor 162 may be a contact type sensor, or any other sensor.

When the plunger 142 pushes the scanner unit 170 up at the urging of the first spring 143, a lower end of the plunger 142 is removed from a sensing region B of the scanner rotation detecting sensor 162 and the scanner rotation detecting sensor 162 is turned on. However, when the scanner unit 170 is returned to its original position, the plunger 142 is pushed down, and the lower end of the plunger 142 is placed in the sensing region B of the scanner rotation detecting sensor 162, switching the scanner rotation detecting sensor 162 off. However, in other aspects of the present invention, the scanner rotation detecting sensor 162 may be switched on when the lower end of the plunger 142 is placed in the sensing region B. Accordingly, the scanner rotation detecting sensor 162 may be in any one of the on and off states when the lower end of the plunger 142 is placed in or is removed from the sensing region B.

The control unit 185 receives an electrical signal from the scanner rotation detecting sensor 162 and determines whether the scanner unit 170 is open or closed based on the electrical signal. When a duplication function is subsequently performed by the image forming apparatus after the scanner rotating unit 140 is actuated and the scanner unit 170 is pushed up about the hinge unit 176, the sheets S will be continuously accumulated in the discharging unit 160. Accordingly, the collective height of the sheets S in the discharge unit 160 will increase again. When the accumulated sheets S are accumulated to contact and rotate the actuator 152, the actuator 152 is placed in the sensing region A of the discharge sensor 151 again cause the discharge sensor 151 to be turned on again. When the actuator 152 is triggered a second time, since the control unit 185 has already received the electrical signal from the discharge sensor 151 and has perceived that the scanner unit 170 is already pushed up, a sheet discharge command is displayed on the operation panel unit 172, instead of the control unit 185 operating the scanner rotating unit 140.

The procedure of expanding the space of the discharging unit 160 in the image forming apparatus 100 according to the present embodiment will now be described in detail with reference to FIG. 5. For sake of convenience, the procedure will be described with reference to FIGS. 1 to 4 using the image forming apparatus 100, but the use of the image forming apparatus 100 with the procedure of FIG. 5 is not required.

In an initial state of the procedure, the hook 142*a* of the plunger 142 is engaged with the engagement jaw 141*b*' of the fixed rod 141*b*. Subsequently, when one of an electrical signal initiated by a user (operation $S_{1a}$), a copy or print command for more than a reference number of sheets (operation $S_{1b}$) per a time (rate of copy or print), or the on state of the discharge sensor 151 (operation $S_{1c}$), or any combination thereof, is transmitted to the control unit 185, the control unit 185 initiates the operation of the scanner rotating unit 140 (operation $S_2$). To begin the operation of the scanner rotating unit 140, a current is applied to the electromagnet 141*a* and the upper end of the fixed rod 141*b* is attracted to the electromagnet 141*a*. This opposes the elastic force of the second spring 141*c* and disengages the engagement jaw 141*b*' of the fixed rod 141*b* from the hook 142*a* of the plunger 142. The plunger 142 is released from the fixed rod 141*b* and is moved upwards by the elastic force of the first spring 143, pushing the scanner unit 170 up (operation $S_3$). The current is applied to the electromagnet 141 for a predetermined period and is interrupted thereafter. Accordingly, after the predetermined period, the upper end of the fixed rod 141*b* is released from the electromagnet 141*a* and the lower end of the fixed rod 141*b* is again pulled towards the main body 110 by the second spring 141*c*, while the upper end of the fixed rod 141*b* comes into contact with the engagement jaw 110*a*.

When the plunger 142 is pushed upwards by the first spring 143, the lower end of the plunger 142 is removed from the sensing region B of the scanner rotation detecting sensor 162. Accordingly, the scanner rotation detecting sensor 162 is in turned on and the on state of the scanner rotation detecting sensor 162 is transmitted to the control unit 185 (operation $S_4$).

Next, when the copy/print function is continuously performed and the sheets S are continuously accumulated in the discharging unit 160 such that the collective height of the accumulated sheets S reaches or becomes greater than the predetermined value, the sheets S contact and rotate the actuator 152 such that the upper end of the actuator 152 is placed in the sensing region A of the discharging sensor 151. Accordingly, the discharge sensor 151 is turned on and the on state of the discharging sensor 151 is transmitted to the control unit 185 (operation $S_5$). At this time, since the control unit 185 perceives that the scanner unit 170 is already pushed up due to the on state of the scanner rotation detecting sensor 162, a sheet discharge command is displayed on the operation panel unit 172, instead of the control unit 185 operating the scanner rotating unit 140 (operation $S_6$).

When the user returns the scanner unit 170 to the original position, the plunger 142 is pushed down and the hook 142*a* engages with the engagement jaw 141*b*' of the fixed rod 141*b*. At the same time, the lower end of the plunger 142 is placed in the sensing region B of the scanner rotation detecting sensor 162, the scanner rotation detecting sensor 162 is turned off, and the off state of the rotation detecting sensor is transmitted to the control unit 185.

The image forming apparatus 100 having the aforementioned structure has the following advantages.

In various aspects of the present invention, the space of the discharging unit 160 can be expanded if necessary by pushing up the scanner unit 170 about the hinge unit 176, while allowing a reduced height of the discharging unit 160. Therefore, the size of the image forming apparatus 100 can be minimized, and a plurality of sheets S can be accumulated in the discharging unit 160.

In various aspects of the present invention, when a predetermined number or more of the sheets S are discharged from the printer unit 190 and accumulated in the discharging unit 160, the scanner unit 170 is automatically pushed up about the hinge 176 by the operation of the discharge sensor unit 150, the control unit 185, and the scanner rotating unit 140. Thus, the apparatus can be conveniently used and paper jams in the discharging unit 160 can be reduced.

In various aspects of the present invention, after the scanner unit 170 is pushed up, the scanner unit 170 is returned to its original position simply by pushing the scanner unit 170 down. That is, when returning the scanner unit 170 to its original position, the user need not push the plunger 142 down and then subsequently push down the scanner unit 170.

According to an aspect of the present invention, it is possible to provide an image forming apparatus capable of expanding the space of a discharging unit without increasing the size of the apparatus.

According to an aspect of the present invention, it is possible to provide an image forming apparatus which can expand and/or restore the space of a discharging unit.

According to an aspect of the present invention, it is possible to provide an image forming apparatus which can expand the space of a discharging unit when necessary to reduce paper jams in the discharging unit.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. Accordingly, it is intended, therefore, that the present invention includes all embodiments failing within the scope of the appended claims.

What is claimed is:

1. An image forming apparatus, comprising:

a main body;

a printer unit provided at the bottom of the main body to print an image on a sheet of printable media;

a discharging unit provided above the printer unit to load the sheet of printable media discharged from the printer unit;

a scanner unit provided above the printer unit to rotate about a hinge unit coupled to the main body so as to open and close the top of the discharging unit;

a scanner rotating unit provided below the scanner unit to rotate the scanner unit, open the top of the discharging unit, and expand the space of the discharging unit, if a collective height of the sheets of printable media accumulated in the discharging unit reaches or exceeds a predetermined value; and a control unit arranged to detect whether the collective height of the sheets of printable media accumulated in the discharging unit reaches or exceeds the predetermined value, and operate the scanner rotating unit in accordance with the detection result, wherein the control unit automatically operates the scanner rotating unit in accordance with the detection result without an input from a user.

2. The image forming apparatus according to claim 1, wherein the scanner rotating unit comprises:

a plunger to reciprocally move and push the scanner unit up or be pushed down by the scanner unit;

a first spring to apply an elastic force to push the plunger towards the scanner unit; and a restriction unit placed adjacent to a first end of the plunger and to restrict the reciprocal movement of the plunger.

3. The image forming apparatus according to claim 2, wherein a second end of the plunger faces a flat surface of the scanner unit and the first end has a hook.

4. An image forming apparatus comprising:

a main body;

a printer unit provided at the bottom of the main body to print an image on a sheet of printable media;

a discharging unit provided above the printer unit to load the sheet of printable media discharged from the printer unit;

a scanner unit provided above the printer unit to rotate about a hinge unit coupled to the main body so as to open and close the top of the discharging unit;

a scanner rotating unit provided below the scanner unit to rotate the scanner unit, open the top of the discharging unit, and expand the space of the discharging unit, if a collective height of the sheets of printable media accumulated in the discharging unit reaches or exceeds a predetermined value; and a control unit arranged to detect whether the collective height of the sheets of printable media accumulated in the discharging unit reaches or exceeds the predetermined value, and operate the scanner rotating unit in accordance with the detection result, wherein a second end of the plunger faces a flat surface of the scanner unit and the first end has a hook, wherein the scanner rotating unit comprises:

a plunger to reciprocally move and push the scanner unit up or be pushed down by the scanner unit, a first spring to apply an elastic force to push the plunger towards the scanner unit, and a restriction unit placed adjacent to a first end of the plunger and to restrict the reciprocal movement of the plunger, and wherein the restriction unit comprises:

a fixed rod having an engagement jaw to engage the hook to hold the plunger at the lower end of a reciprocal movement path of the plunger, an electromagnet to be attached or detached to the upper end of the fixed rod such the hook escapes from the engagement jaw or is engaged to the engagement jaw to fix the plunger, and a second spring to elastically bias the lower end of the fixed rod which is furthest from the engagement jaw towards the main body.

5. The image forming apparatus according to claim 4, wherein the fixed rod is formed of a magnetic material.

6. The image forming apparatus according to claim 4, wherein the main body further comprises a scanner rotation detecting sensor placed below the plunger in an opposite direction of the plunger from the scanner unit, wherein when the plunger pushes the scanner unit up, the scanner rotation detecting sensor is turned on, and when the scanner returns to an original position, the plunger moves downward, the hook of the plunger engages with the engagement jaw of the fixed rod, and the scanner rotation detecting sensor is turned off.

7. The image forming apparatus according to claim 6, wherein the main body further comprises a discharge sensor unit positioned in at least one of the scanner unit, the printer unit, and/or a portion between the scanner unit and the printer unit, and to detect whether the collective height of the sheets accumulated in the discharging unit reaches or exceeds the predetermined value, and to operate the scanner rotating unit in accordance with the detection result.

8. The image forming apparatus according to claim 7, wherein the discharge sensor unit comprises a discharge sensor, and an actuator, wherein one end of the actuator is adjacent to the discharge sensor and another end of the actuator is placed at a certain position of the discharging unit, wherein, when the collective height of the sheets accumulated in the discharging unit reaches or exceeds the predetermined value, the actuator rotates due to contact with the accumulated sheets and operates the discharge sensor, and the discharge sensor transmits an electrical signal to the control unit to activate the scanner rotating unit.

9. The image forming apparatus according to claim 8, wherein, when the collective height of the sheets accumulated in the discharging unit reaches or exceeds the predetermined value and the actuator rotates due to contact with the accumulated sheets, the discharge sensor is turned on, and when the scanner rotating unit operates and the scanner unit is pushed up such that the actuator is spaced apart from the accumulated sheets of printable media, the discharge sensor is turned off.

10. The image forming apparatus according to claim 9, wherein, when the sheets are continuously accumulated in the discharging unit to increase the collective height of the sheets after the scanner rotating unit has operated and the scanner unit has been pushed up, the actuator operates again due to contact with the increased height of the accumulated sheets, the discharge sensor unit is turned on, and the control unit allows a sheet discharge command to be displayed.

11. The image forming apparatus according to claim 8, wherein the scanner rotating unit is operated by an electrical signal according to at least one of the on state of the discharge sensor, the manipulation of a user, and a copy or print command for at least a predetermined number of sheets.

12. The image forming apparatus according to claim 11, wherein at least one of the scanner rotation detecting sensor and the discharge sensor is a photo sensor.

13. An image forming apparatus, comprising:

a main body;

a scanner unit hinged to the main body;

a discharge unit provided between the main body and the scanner unit;

a scanner rotating unit provided between the main body and the scanner unit, the scanner rotating unit comprising a reciprocating plunger that is not fixed to the scanner unit; and a sensor to detect a collective height of sheets of printable media accumulated in the discharge unit, wherein a discharge command is generated by a second signal from the sensor.

14. The apparatus of claim 13, wherein the reciprocating plunger pushes the scanner unit away from the main body to open the discharge unit.

15. The apparatus of claim 13, wherein the reciprocating plunger is actuated by a first signal from the sensor.

16. The apparatus of claim 13, wherein the discharge command is generated after the actuation of the reciprocating plunger.

* * * * *